US006365310B1

(12) United States Patent
Sakamoto et al.

(10) Patent No.: US 6,365,310 B1
(45) **Date of Patent: *Apr. 2, 2002**

(54) DEVELOPING METHOD AND A DEVELOPER FOR ELECTROPHOTOGRAPHY

(75) Inventors: Kiyoshi Sakamoto; Kazuhito Wada, both of Hyogo-ken (JP)

(73) Assignee: Sanyo Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/882,820

(22) Filed: Jun. 26, 1997

Related U.S. Application Data

(63) Continuation of application No. 08/619,127, filed on Mar. 20, 1996, now abandoned, which is a continuation of application No. 08/335,555, filed on Nov. 7, 1994, now abandoned, which is a continuation of application No. 08/180,782, filed on Jan. 10, 1994, now abandoned, which is a continuation of application No. 08/017,352, filed on Feb. 11, 1993, now abandoned, which is a continuation of application No. 07/780,375, filed on Oct. 21, 1991, now abandoned, which is a continuation of application No. 07/395,284, filed on Aug. 9, 1989, now abandoned, which is a continuation of application No. 06/820,186, filed on Jan. 17, 1986, now abandoned.

(30) Foreign Application Priority Data

Jan. 19, 1985 (JP) ..... 60-007726
Nov. 20, 1985 (JP) ..... 60-260825

(51) Int. Cl.[7] ..... G03G 9/10; G03G 9/00; G03G 5/00

(52) U.S. Cl. ..... 430/107.1; 430/108.1; 430/111.1; 430/111.2; 430/137.13

(58) Field of Search ..... 430/108, 109, 430/107.1, 108.1, 111.1, 111.2, 137.1, 137.13

(56) References Cited

U.S. PATENT DOCUMENTS

| | | | | | |
|---|---|---|---|---|---|
| 3,838,054 | A | * | 9/1974 | Trachtenberg | 430/108 X |
| 3,849,182 | A | * | 11/1974 | Hageubach | 430/108 |
| 3,895,125 | A | * | 7/1975 | Tsuchiga | 430/111 X |
| 3,947,370 | A | * | 3/1976 | Miller | 430/106.6 |
| 4,038,076 | A | * | 7/1977 | Lipani | 430/120 |

FOREIGN PATENT DOCUMENTS

| | | | | |
|---|---|---|---|---|
| JP | 204560 | * | 12/1982 | 430/108 |
| JP | 61-215559 | * | 9/1986 | |

* cited by examiner

*Primary Examiner*—S. Rosasco
(74) *Attorney, Agent, or Firm*—Darby & Darby

(57) ABSTRACT

A developer for electrophotography comprises toner particles and carrier particles. The carrier particles comprise at least two kinds of carriers particles having different charge giving characteristics onto the toner particles. Plural kinds of carrier particles having different charge giving characteristics act on one another and on the toner particles.

10 Claims, 3 Drawing Sheets

DEVELOPING METHOD AND A DEVELOPER FOR ELECTROPHOTOGRAPHY

This is a continuation of application Ser. No. 08/619,127, filed Mar. 20, 1996 now abandoned, which is a continuation of application Ser. No. 08/335,555, filed Nov. 7, 1994 now abandoned, which is a continuation of application Ser. No. 08/180,782, filed Jan. 10, 1994 (now abandoned), which is a continuation of application Ser. No. 08/017,352, filed Feb. 11, 1993 (now abandoned), which is a continuation of application Ser. No. 07/780,375, filed Oct. 21, 1991 (now abandoned), which is a continuation of application Ser. No. 07/395,284, filed Aug. 9, 1989, abandoned, which, in turn, is a continuation of application Ser. No. 06/820,186 filed Jan. 17, 1986, (now abandoned).

BACKGROUND OF THE INVENTION

1. Field of the Invention

The present invention relates to a developing method and a developer for electrophotography. More specifically, the present invention relates to a so-called dual-component developer wherein toner particles and carrier particles are mixed, and a developing method for electrophotography employing such developer.

2. Description of the Prior Art

In a method of developing a latent image by a magnetic brush, a mixture of toner particles composed of resin and carbon and carrier particles composed of iron particles, magnetic particles or glass balls is employed as a developer. To be detailed, the both are friction-charged by mixing them, having charges of polarities reverse to each other, and resultingly, by properly selecting a friction charging series of toner particles and carrier particles according to the polarity of a latent image, the latent image is developed as a visible image by making the toner particles adhere electrostatically to a photosensitive drum while neutralizing charges on the latent image.

Developing in electrophotography is a process wherein following F=qE, a toner particle having a charge quantity q is driven by an electric field intensity E corresponding to a latent image on an image carrier surface, and the toner is made to adhere to and is held on the latent image, and the latent image is visualized while the charges on the latent image are neutralized. Actually, the process is complicated by actions of the other forces, but it is unchangeable that this electrostatic Coulombs force F is dominant.

Then, effects on the image quality and on the process of electrophotography were studied with the charge quantity of toner particles, namely, the density of charges on the toner particles employed as a parameter, and the following Table 1 was obtained.

TABLE 1

| | Quality of developed image of electrophotography | | | |
|---|---|---|---|---|
| | Density | Edge effect | Hollow phenomenon | Fogging |
| Density of charges of toner | | | | |
| (High) | Low | Strong | Large | Small |
| (Low) | High | Weak | Nil | Large |
| | Effects on processes for electrophotography | | | |
| | Scattering of toner | Consumption of toner | Latitude to exposure process | Dependence on ratio of mixing toner |
| Density of charges on toner | | | | |
| (High) | Small | Small | Wide | Great |
| (Low) | Large | Large | Narrow | Less |

As is obvious from this Table 1, if this quantity of charge on toner particles is large, the charges on the latent image can be neutralized by a small quantity of toner particles. In reverse, if the quantity of charges on the toner particles is small, a large quantity of toner particles are required, and resultingly, the developing density becomes high, but the consumption of toner particles becomes large. Also, if the quantity of charges on toner particles is large, a strong edge effect takes place, and further a so-called hollow phenomenon takes place, and besides, a change in the quantity of charges on toner particles with respect to a change in the density of toner particles is large, and thereby it is very difficult to obtain a constant image quality.

However, if the quantity of charges on toner particles becomes excessively small, an electrostatic attracting force between a toner particle and a carrier particle is reduced, thereby causing the toner particles to scatter in the apparatus in transit of a developer or causing a so-called fogging by adhesion of toner particles onto a non-image part of the latent image surface.

Then, consideration is made on preparing a developer having an intermediate characteristic between the characteristic of a large quantity of charges on toner particles and the characteristic of a small quantity thereof. However, in a developer obtaining such a characteristic by controlling only the characteristic or the value of physical property of the developer, when it is used repeatedly, the characteristic itself changes and resultingly, a so-called spend phenomenon takes place that the developer shifts to the one having either of the characteristic of a large quantity of charges and the characteristic of a small quantity of charges. This means that even a properly prepared developer has a problem of lacking the stability with time of the quantity of charges on the toner particles.

Also, so-called color copying machines roughly includes machines having a monotone multi-color copying function and machines having a full-color copying function. In the former, developing is performed at different developing stations for respective colors by developers containing color toner particles desirably colored, and thereby a monotone multi-color copy is obtained. In the latter, a latent image is developed by developers of respective colors containing respective color toner particles of yellow, magenta and cyan, and they are superposed to obtain a full-color, over-coated color copy.

A large difference of such color toner particles used for color copying machines or the like from the above-described black toner particles is an addition of a dye or a pigment which makes a required coloring in place of a black pigment, carbon black, magnetite or the like.

The conventional color developers which are obtained by mixing color toner particles with carrier particles have different electric characteristics (quantity of charges on toner particles and distribution of quantity of charges) and different physical properties (conveyability and agglomeratability) for the developer of each color depending upon the difference in the added dye or pigment or charge controlling agent. Accordingly, for example, in the case of the electronic copying machine or the like, conditions for the copying process, for example, conditions for charging, transferring, developing and fixing are required to be set for each color in accordance with differences in these characteristics.

Also, imbalances in the developing characteristics and the persistence of image quality take place between the developers of respective colors depending upon the above-mentioned differences in the electric characteristics and the physical characteristics, and therefore it is required to average or equalize the quantities of charges, distributions thereof, effects of the quantity of charges due to change in toner density, fixing properties, image characteristics or particulate characteristics of the developers of respective colors.

For this reason, conventionally, in the case where color developers are used, in designing base resins, colorants or charge controlling agents for color toner particles, the degree of freedom thereof is limited to a great extent, and a closer consideration is required in comparison with the conventional black developers.

This means that the conventional method of developing a latent image by using color developers of respective colors whose main components are color toner particles and carrier toner particles has many practical difficulties due to the above-described problems peculiar to the developers. Such difficulties are present likewise also in the case of such copying machine that obtains a monocolor copy by replacing a developing apparatus for each color.

SUMMARY OF THE INVENTION

Therefore, a principle object of the present invention is to provide a developing method for electrophotography and a developer for it which can obtain an electrophotograph of a stable image quality over a long period.

Another object of the present invention is to provide a developing method for electrophotography and color developers for it which are suitable for the color electrophotographing apparatus.

In brief, the present invention is a developer wherein toner particles are mixed with two or more kinds of carrier particles whose charge giving characteristics onto the toner particles differ from one another.

In accordance with the present invention, the distribution of the quantity of charges in the developer is improved by the presence of carrier particles whose charge giving characteristics onto toner particles are different, and thereby an ideal distribution can be achieved. That is to say, in accordance with the present invention, the developed image quality can be improved without complicating the developing apparatus, without requiring any special additional apparatus and also without strictly controlling the developer characteristics of carrier particles and toner particles. Also, spreading with time of the distribution of quantities of charges on toner particles, that is, deterioration of the developer can be prevented by such an action of carrier particles, and therefore a developer having a longer lifetime is obtainable in comparison with the conventional developer. Consequently, the maintenance cycle or the cycle of replacing the developer can be elongated and the maintenance thereof and the like are simplified.

These objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 3 shows a case where toner particles of reverse polarity appear, and FIG. 4 shows a case where the distribution of the quantity of charges spreads excessively.

FIG. 5 shows change in the quantity of charges versus copy volume, and FIG. 6 shows the quantity of spent toner versus copy volume.

DESCRIPTION OF THE PREFERRED EMBODIMENTS

Figure 1:
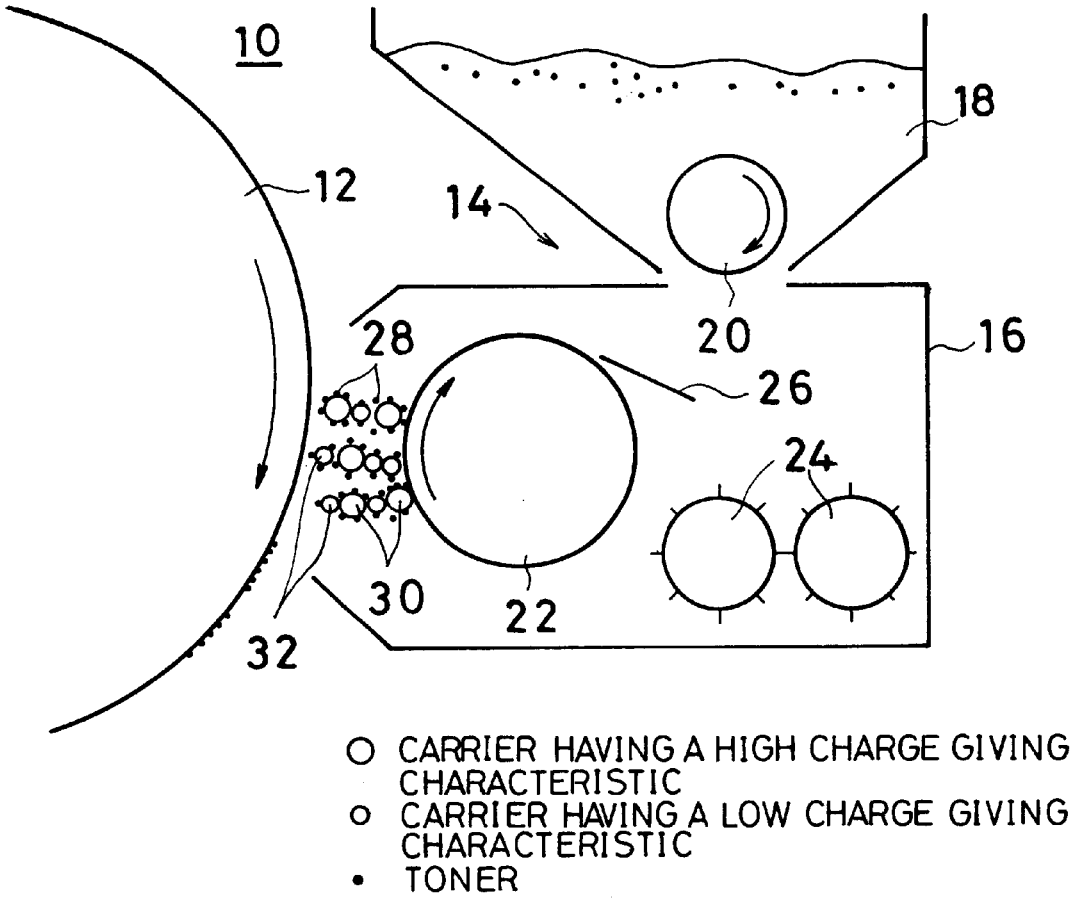
FIG. 1 is an illustrative view of a major part showing one embodiment in accordance with the present invention.

FIG. 1 is an illustrative view showing a part of an electrophotographic copying machine whereto the present invention is applied. It is pointed out in advance that the present invention can be applied also to electrophotographic apparatuses other than such copying machine, for example, printers, facsimiles or the like.

An electrophotographic copying machine 10 comprises a photosensitive drum 12, and this photosensitive drum 12 is rotated in the direction as shown by an arrow. A developing apparatus 14 is installed in the vicinity of this photosensitive drum 12. The developing apparatus 14 comprises a developer container 16 and a feeding hopper 18 for feeding the container with a developer. A screw conveyor or a screw roller 20 for feeding the developer from the feeding hopper 18 to the under container 16 is installed in the feeding hopper 18. A magnetic roller or a developing sleeve 22 is installed in the developer container 16, and this developing sleeve 22 can be rotated in the direction as shown by an arrow, namely, in the direction reverse to that of the photosensitive drum 12. Furthermore, a stirrer 24 is installed in the container 16, and thereby the developer in this container is stirred. In the vicinity of the developing sleeve 22, a doctor blade (not illustrated) for limiting the height of ears of the developer adhering thereto, a scraper 26 for scraping the developer adhering to this sleeve and so on are installed associated therewith.

In this embodiment, the developer is constituted as a dual-component developer of mixed-carrier type wherein toner particles 28, carrier particles 30 whose charge giving characteristic onto the toner particles 28 is relatively high and carrier particles 32 whose charge giving characteristic onto the toner particles 28 is relatively low are mixed.

By using such a mixture of plural kinds of carrier particles having different charge giving characteristics, various effects as specifically described hereinafter are obtained which have not been considered conventionally.

(A) Control of the Quantity of Charges is Facilitated and Unified.

In case where different kinds of developers are used in the same electrophotographic apparatus like the color developers, if the electric characteristic, in particular, the quantity of charges on each color toner particles is not uniform, adverse effects on the image quality or electrophotographic process as shown on the previous Table 1 takes place. Then, in accordance with the embodiment of the present invention, plural kinds of carrier particles are mixed with color toner particles, and thereby differences in characteristics between developers of respective colors can be made relatively small.

(B) Charging Characteristics and the Image Quality are Improved.

Defects of carrier particles having different charge giving characteristics are compensated for one another. For example, when carrier particles having a high charge giving characteristic are present, they can give charges to non-charged-toner particles or weakly charged toner particles which are separated electrostatically from toner particles or carrier particles which have a necessary minimum or more quantity of charges. Also, the carrier particles having a low charge giving characteristic onto toner particles prevent a collective distribution in the highly charged region. This means that in the region of distribution of high quantities of charges, the carrier particles having a low charge giving characteristic act on the toner particles, and in the region of distribution of low quantities of charges, the carrier particles having a high charge giving characteristic act on the toner particles, respectively.

Consequently, spreading of the distribution of the quantity of charges of the toner particles can be prevented, and also fogging or scattering in the apparatus can be prevented. Besides, when taking notice of the absolute value of quantity of charges held by toner particles, disadvantages caused by a low value of the quantity of charges on the toner particles Q/M ($\mu$C/g), that is, an excessively high density of copy, a weak edge effect and the like are improved and thereby the image quality can be further improved.

In reverse, in the case where the quantity of charges on the toner particles is extremely large, the presence of the carrier particles having a relatively low charge giving characteristic can suppress the distribution of the quantity of toner particles which has been present in a probability fashion in the region of large quantity of charges. Resultingly, a lack of density of solid, a hollow effect, recapture of the toner particles adhering to the latent image by injected charges and so on are prevented, and thereby even thin wires or images of low contrast can be well reproduced with a good image quality of continuous tone. At the same time, toner particles having an extremely large quantity of charges are removed, and therefore a so-called carrier adhesion to the high potential surface of latent image caused by toner particles accompanied by carrier particles can be prevented, and thereby secondary evils attending on a damage to the photosensitive drum or scattering in the apparatus can be prevented.

Figure 2:
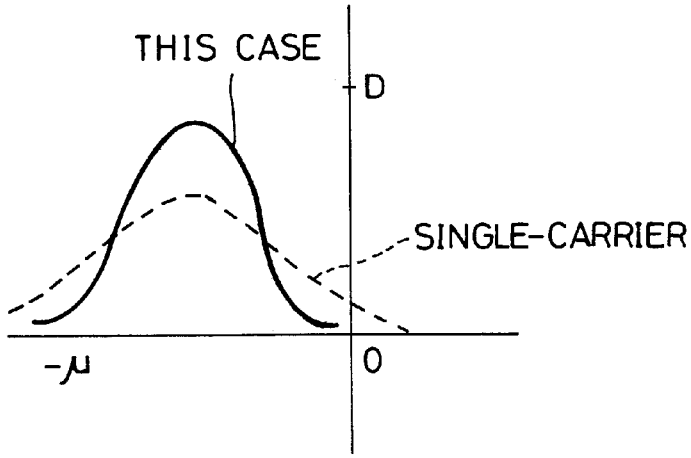
FIG. 2 is a graph showing a distribution of the quantity of charges of the embodiment in FIG. 1 in comparison with that of a single-carrier developer.

Based on the results of the measurement of the above-described by a toner charge spectrograph, schematic description is made as shown in FIG. 2. In this FIG. 2, X-axis represents $\mu$ (quantity of charges ($\mu$C)/diameter of toner particle ($\mu$m) and Y-axis represents probability of presence of $\mu$. In this FIG. 2, a dotted line shows a general distribution of the quantity of charges on toner particles of the conventional single-carrier developer, and a solid line shows a distribution of the quantity of charges of a mixed-carrier developer wherein plural kinds of carrier particles having different charge giving characteristics onto toner particles are present as in the case of this embodiment.

As is obvious from this FIG. 2, in the region of distribution of large quantities of charges, carrier particles having a low charge giving characteristics act on toner particles, and in reverse, in the region of distribution of small quantities of charges, the carrier particles having a high charge giving characteristic act on non-charged toner particles or weakly charged toner particles, and resultingly, the conventional distribution as shown by the dotted line can be turned into a relatively sharp distribution as shown by the solid line, and thereby an ideal distribution of the quantity of toner charges by the dual-component developer can be obtained.

(C) Stability with Time and Persistence are Improved.

An effect of the presence of a mixture of carrier particles having a high and a low charge giving characteristics can be expected even for repetitive use for a long period. More specifically, in the developing method by the dual-component developer, developing is performed in a manner that carrier particles and toner particles are mixed and stirred, and the both are absorbed electrostatically by the friction-charging thereof to form a magnetic brush by a magnetic force, being brought in contact with the latent image. In this case, the toner particles in the developer are made to adhere to the image part by an electrostatic force of the latent image, being consumed; however, the carrier particles are not consumed, being used intact repeatedly. Thus, when the developer is used for a long period, the following problems take place.

(i) Toner particles not contributing to developing, so-called spent toner particles cover the surfaces of carrier particles, and the ability of carrier particles for friction-charging toner particles is reduced, resulting in adverse effects on the image or the process such as a change in the developed image, occurrence of fogging, scattering of toner particles in the apparatus and a carrier adhesion.

(ii) Only toner particles are consumed, and if the amount of replenishment thereof is not proper, the developer goes beyond a proper region to become a low toner density or a high toner density, and the toner particles scatter, or carrier adhesion, fogging or the like takes place, and the image quality or the apparatus is adversely affected likewise the case of (i).

Figure 3:
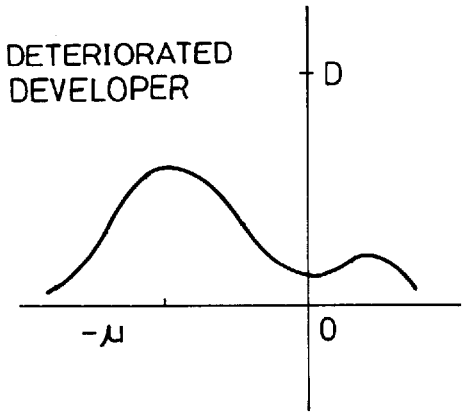
FIG. 3 and FIG. 4 are graphs for explaining a phenomenon of deterioration of a developer.
Figure 4:
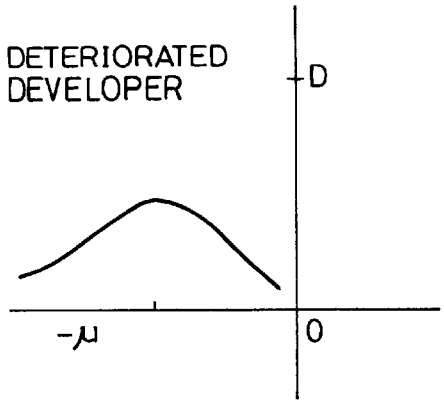

Evaluation of the above-described by the toner charge spectrograph resulted in as shown in FIG. 3 and FIG. 4. Thus, repetitive use of the developer for a long period accelerates the spend effect and then deterioration, and thereby not only a relatively sharp distribution of the quantity of charges at starting spreads gradually as shown in FIG. 4, but also toner particles charged in reverse polarity sometimes appear as shown in FIG. 3.

By contrast, when carrier particles having relatively high charge giving characteristics and carrier particles having relatively low charge giving characteristics are present in a mixed fashion, their disadvantages can be compensated mutually by their advantages, and thereby when toner particles of reverse polarity as shown in FIG. 3 appear, carrier particles having high charge giving characteristics act thereon, and thereby spreading of the distribution of the quantity of charges on the toner particles can be prevented. Accordingly, a stable image can be obtained even for a copy volume of about double in comparison with that of the conventional single-carrier developer, and the lifetime of the developer can be elongated.

Figure 5:
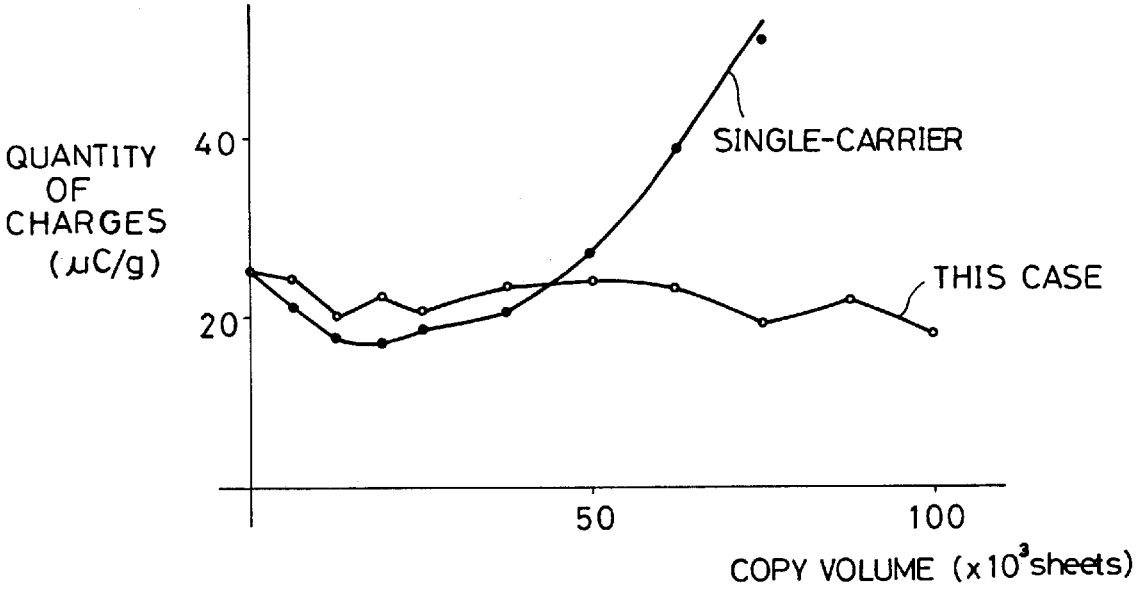
FIG. 5 and FIG. 6 are graphs for explaining an effect of the embodiment in accordance with the present invention.
Figure 6:
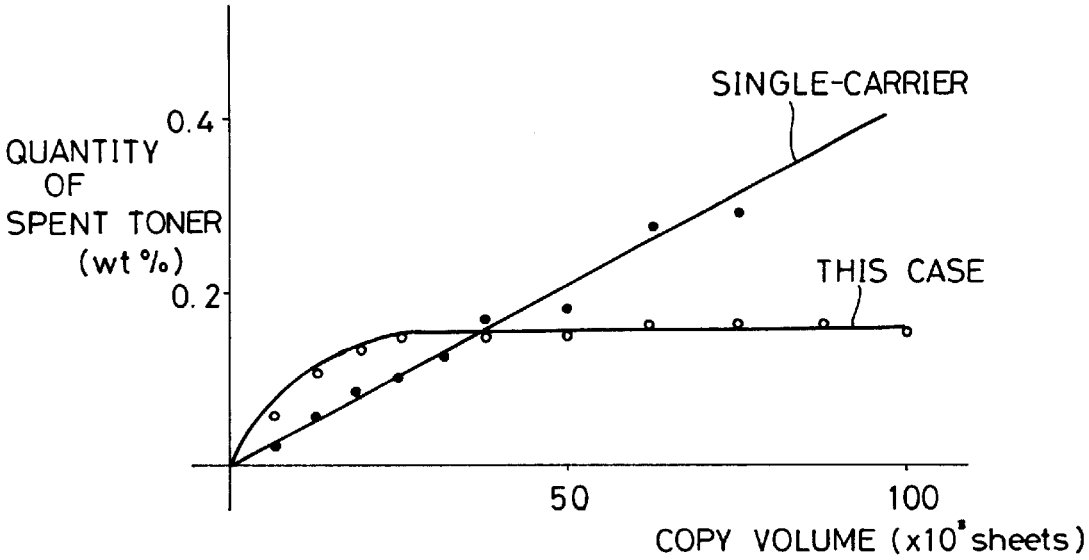

This is shown in FIG. 5 and FIG. 6. FIG. 5 shows the change in the quantity of charges versus the copy volume and FIG. 6 shows the change in the quantity of spent toner versus the copy volume. This means that in the case of the conventional single-carrier developer, when the copy volume becomes large, that is, when used repeatedly for a long period, the quantity of charges of the developer is varied to a great extent. On the other hand, in the case of the mixed-carrier developer wherein two or more kinds of carrier particles having different charge giving characteristics are present in a mixed fashion, they can be compensated mutually as described above, and therefore the quantity of charges of toner particles is stable with time as shown in FIG. 5. Similarly when carrier particles having different charge giving characteristics are present in a mixed fashion, the quantity of spend toner particles can be suppressed to a very small value as shown in FIG. 6.

(D) Dependence of the Quantity of Charges upon the Change in Toner Density is Alleviated.

Furthermore, in the case where the quantity of toner replenishment for copy load is improper, for example, in the case where the toner density is low, distribution of the quantity of charges spreads as shown in FIG. 4, and thereby fogging and carrier adhesion are increased and the image quality of electrophotograph, photosensitive member or the edge of the cleaning blade is damaged, and thereby the apparatus is sometimes damaged vitally. However, if the carrier particles having different charge giving characteristics onto toner particles are present in a mixed fashion as is the case with this embodiment, the distribution of the quantity of charges of the developer can be brought close to an ideal shape as described above, and therefore it is needless to say that such a problem can be solved, and also an image of a reduced copy density and an image having an excessively strong edge effect due to a reduced toner density are not produced, and the dependence of the image quality upon the change in toner density, that is, the dependence of distribution of the quantity of charges upon the toner density can be alleviated, and the reliability and the effect thereof in the electrophotographic processes such as extension of allowable width of control of the toner density become outstandingly great.

Figure 7:
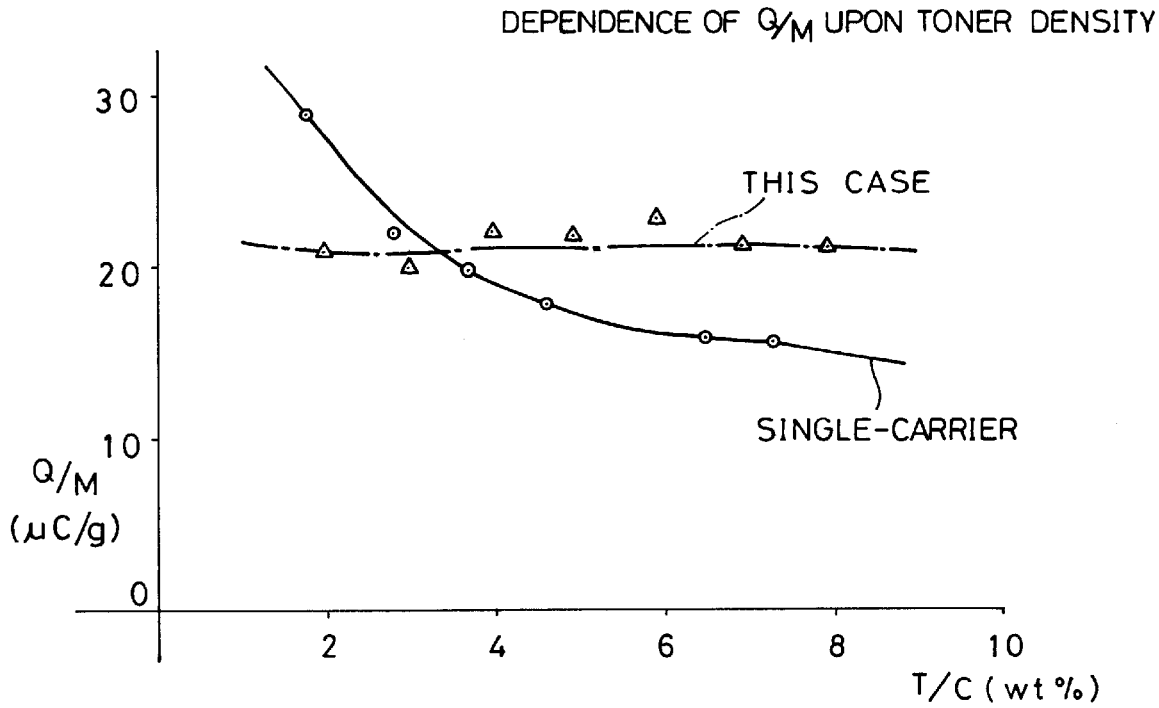
FIG. 7 is a graph showing dependence of the quantity of charges upon the toner density.

Next, this is described based on the dependence of the average quantity of charges on the toner particles in the developer upon the change in the toner density in reference to FIG. 7. In the conventional single-carrier group, as shown in FIG. 7, when the ratio of toner particles to carrier particles T/C (wt %) becomes large, the quantity of charges held by the toner particles Q/M ($\mu$C/g) is reduced, and in reverse, when T/C becomes small, Q/M is increased and the characteristics as shown in the previous table 1 are obtained. On the other hand, as is the case with this embodiment, when a developer of mixed-carrier group wherein carrier particles having a high and a low charge giving characteristics onto toner particles are mixed is used, an effect similar to that for the distribution of the quantity of charges can be expected. That is to say, as shown in FIG. 7, in the mixed-carrier developer of this embodiment, the dependence of Q/M upon the toner density is obviously alleviated in comparison with the single-carrier developer, and thereby the allowable width of toner control is extended from the standard toner density ±(0.5–1)% to ±(3–4)%, and thereby a great effect can be given on the toner density controlling system.

Thus, in the embodiments in accordance with the present invention, improvement in the image quality and alleviation of dependence of the quantity of charges upon the change in toner density can be carried out by controlling the quantity of charges of toner particles and the distribution thereof by mixed-carriers composed of carrier particles having a relatively high and a relatively low charge giving characteristics onto toner particles, and further the cycle of replacing the developer in repetitive use can be elongated.

Embodiment 1

For example, carrier particles having a relatively high charge giving characteristic composed of Ba—Zn group ferrite carrier particles (average diameter: 93 $\mu$m, inherent resistance: $1.7\times10^9$ Ωcm, Q/M: 29.6 $\mu$C/g) and, for example, carrier particles having a relatively low charge giving characteristics composed of Cu—Zn group ferrite carrier particles (average diameter: 64 $\mu$m: inherent resistance : $8.7\times10^8$ Ωcm, Q/M: 19.1 $\mu$C/g) were mixed by a ratio of 5.6:1 to form mixed-carriers,. Toner particles of 11.9 $\mu$m in average diameter were added thereto so as to become 6.2 wt %, and a dual-component developer was obtained.

The quantity of charges held by the toner particles of this mixed-carrier developer became 23.6 $\mu$C/g and the dependence thereof upon the change in toner density was 1.6–9.7%. Then, as shown in FIG. 2, the measurement of distribution of the quantity of charges showed the results better than those of the conventional single-carrier developer.

The results of developing with such a developer by using a magnetic brush developing apparatus were non-hollowing, non-fogging, a good reproductivity with continuous tone and a good reproductivity of wires or a low-contrast figures in the image quality. As to the electrophotographic process, scattering of toner particles or adhesion of carrier particles did not take place and also the cycle of replacing the developer was elongated by 2.4 times in comparison with that of the single-carrier developer.

Embodiment 2

Ba—Zn group ferrite carrier particles (93 $\mu$m, $1.7\times10^9$ Ωcm, 26.6 $\mu$C/g) as carrier particles having a high charge giving characteristic and iron oxide powder group carrier particles (54 $\mu$m, $7.8\times10^7$ Ωcm, 18.4 $\mu$C/g) as carrier particles having a low charge giving characteristic were mixed by a ratio of 8:1 to form mixed-carriers, and toner particles of 11.9 $\mu$m in average diameter were added thereto so as to become 5.6 wt % to prepare a developer.

Embodiment 3

Spherical iron powder group carrier particles (106 $\mu$m, $2.7\times10^9$ Ωcm, 25.6 $\mu$C/g) were used as carrier particles having a high charge giving characteristic, and iron powder group carrier particles (54 $\mu$m, $7.8\times10^7$ Ωcm, 16.1 $\mu$C/g) were used as carrier particles having a low charge giving characteristic, and they were mixed by a ratio of 8:1 to form mixed-carriers, and toner particles of 11.9 $\mu$m in average diameter were added thereto so as to become 5.6 wt % to prepare a developer.

Both Embodiment 2 and Embodiment 3 showed good characteristics like Embodiment 1.

Embodiment 4

A red developer was prepared in place of a black developer based on Embodiment 2. In Embodiment 2, carrier particles having a high charge giving characteristic, carrier particles having a low charge giving characteristic and toner particles were 83.9 wt %, 10.5 wt % and 5.6% wt % respectively, while in this case they were 64.4 wt %, 30 wt % and 5.6 wt % respectively.

The present invention is effective also for the color developer. Accordingly, in accordance with the present invention, the degree of freedom in designing color toner particles and developers is improved to a great extent and manufacturing of the developers is facilitated and the following effects can be obtained.

(i) Changing the kind of carrier particles on a color basis is not required, and the same kind of carrier particles can be used for respective colors by changing the ratio of constitution of plural kinds of carrier particles having different charge giving characteristics. This means that kinds, electric resistances or shapes of carrier particles, kinds of charge controlling agents to be added thereto and so on can be suppressed to a minimum number, and thereby troublesomeness in manufacturing and keeping the developer can be eliminated.

(ii) The quantity of charges of toner particles which is a basic characteristic of the developer can be controlled also by the ratio of constitution of carrier particles having difference charge giving characteristics in addition to the charge controlling agent, and therefore the degree of freedom in designing color toner particles or the degree of freedom in selecting the kind of carrier particles or in designing them is improved. Accordingly, restrictions on preparing material are removed to a great extent due to the following advantages such as (a) copying under the same processing conditions for respective colors, (b) unifying electric characteristics, physical characteristics or persistence of the image quality among respective color developers, (c) color mixing characteristic, coloring characteristic, clearness, or color reproductivity, and (d) common use of binder resin among respective color developers. Therefore, improvements in performances and characteristics of the color electrophotography can be expected in these points.

(iii) Unifying the quantity of charges on color toner particles is facilitated, and therefore it is not required to change the conditions for charging, transferring, exposure or fixing on a color basis.

(iv) Improvement in distribution of the quantity of charges on color toner particles, suppression of toner spending and improvement in the image quality can be carried out by the presence of carrier particles having different charge giving characteristics in a mixed fashion, and a stable image quality can be obtained for over a long period.

(v) Charge giving characteristics and physical characteristics of carrier particles can be controlled simultaneously. This means that by corresponding the diameter, shape (spherical, flat, or unfixed), magnetic characteristics (saturated magnetization, coercive force), developing electrode effect or the like to a high or a low charge giving characteristic, transferring characteristic and stirring characteristic caused by the particle diameter and shape, tip lacking and sweeping-together caused by magnetic characteristics and dependence of the quantity of toner charges upon the change in toner density and the developing electrode effect caused by electric resistance can be controlled together simultaneously with the charge giving characteristics.

Embodiment 5

Color developers for respective colors (black, red and blue) were prepared by employing carrier particles and color toner particles as shown in the following Table 2 and Table 3.

TABLE 2

(Carrier particle)

| | Carrier particles having a low charge giving characteristics | Carrier particles having a low charge giving charateristics |
|---|---|---|
| Kind | Copper-zinc group ferrite | Barium-zinc group ferrite |
| Shape | Nearly spheric | Nearly spheric |
| Average particle diameter | 93 $\mu$m | 64 $\mu$m |
| Electric resistance | $8.7\times10^8$ Ωm | $1.7\times10^9$ Ωm |
| Saturated magnetization | 58 emu/g | 58 emu/g |
| Bulk specific gravity | 2.56 g/cm$^3$ | 2.15 g/cm$^3$ |
| Fluidity | 23.8 sec/50 g | 27.9 sec/g |

TABLE 3

(Toner particles)

| | Black | Red | Blue |
|---|---|---|---|
| Binder resin | Styrene, methyl-methacrylate, | Same as the left column | Same as the left column |

TABLE 3-continued

| | (Toner particles) | | |
|---|---|---|---|
| | Black | Red | Blue |
| | butylacrylate copolymer | | |
| Pigments | Carbon black | Azolake pigment | Prussian |
| Charge controlling agent | Monoazo pigment metal complex salt | Same as the left column | Same as the left column |
| Fluidizing agent | Colloidal silica | Same as the left column | Same as the left column |
| Cleaning agent | Fluoline surface activator | Same as the left column | Same as the left column |

In the case where carrier particles having a high charge giving characteristic were used as the conventional single-carrier developer, the quantities of charges on toner particles for black, red and blue were 28.5 ($\mu$C/g), 37.8 ($\mu$C/g) and 42.5 ($\mu$C/g), respectively. Also, in the case where only carrier particles having a low charge giving characteristic were used, the quantities of charges on toner particles were 16.1 ($\mu$C/g), 21.6 ($\mu$C/g) and 23.2 ($\mu$C/g), respectively.

On the other hand, in accordance with the present invention, two kinds of carrier particles as shown in Table 2 were mixed, and the ratio of carrier particles having a high charge giving characteristic to carrier particles having a low charge giving characteristic and color toner particles were set to 14.6 wt %, 80.0 wt % and 5.6 wt % for black, to 55.1 wt %, 37.4 wt % and 7.5 wt % for blue as shown in Table 3. Then, the quantity of charges on toner particles became 24.1 ($\mu$C/g), 24.8 ($\mu$C/g) and 25.1 ($\mu$C/g) respectively for black, red and blue. Also, the dependence thereof upon the change in the toner density was 1.8–10% as shown in FIG. 7.

Furthermore, the results of measurements of distributions of the quantity of charges on toner particles were better for each color in comparison with those of the single-carrier group as shown in FIG. 2.

Developing was performed using such color developers by the apparatus as shown in FIG. 1, and similar copy image qualities were obtained for respective colors and it was not necessary to set the conditions for each copying process on a color basis. Other effects similar to those in Embodiment 1 were obtained. Also, in the case of color toners, conventionally transferring characteristics and stirring characteristics were not so good. However, in accordance with this embodiment, carrier particles having a low electric resistance and a large particle diameter were relatively increased in number, and therefore the transferring characteristics and the stirring characteristics were improved and agglomeration of toner particles and the image quality were improved.

Embodiment 6

Ba—Zn group ferrite carrier particles (64 $\mu$m, $1.7\times10^9$ $\Omega$cm, 28.6 $\mu$C/g) as carrier particles having a high charge giving characteristic and iron oxide powder group carriers (105 $\mu$m, $7.8\times10^7$ $\Omega$cm, 18.4 $\mu$C/g) as carrier particles having a low charge giving characteristic were mixed by a ratio of 7:1 to form a mixed-carrier group, and color toner particles of 11.9 $\mu$m in average diameter were added so as to become 5.6 wt % to prepare a color developer.

Embodiment 7

Spherical iron powder group carrier particles (54 $\mu$m, $2.7\times10^9$ $\Omega$cm, 25.6 $\mu$C/g) were used as carrier particles having a high charge giving characteristic and iron powder group carrier particles (106 $\mu$m, $7.8\times10^7$ $\Omega$cm, 16.1 $\mu$C/g) were used as carrier particles having a low charge giving characteristic, and they were mixed by a ratio of 8:1 to form a mixed-carrier group, and color toner particles of 11.9 $\mu$m in average diameter were added so as to become 5.6 wt % to prepare a color developer.

Both Embodiment 6 and Embodiment 7 showed good characteristics like Embodiment 5.

Thus, preparing the color developer can be facilitated only by changing the mixing ratio of carrier particles having different charge giving characteristics. Furthermore, fixing can be made under the same fixing conditions for each color, and therefore a large restriction on manufacturing the color copying machine is eliminated.

In the above-described Embodiments 1 and 5, barium group ferrite whose saturated magnetization is relatively low, for example, [(Ba, Ni, Zn) $OFe_2O_3$] was utilized as carrier particles having a high charge giving characteristic, and Cu group ferrite whose saturated magnetization is relatively high was utilized as carrier particles having a relatively low charge giving characteristic.

In Embodiments 2 and 4, transition metal (Fe, Ni, Co, Zn) group ferrite was used as carrier particles having a high charge giving characteristic, and iron powder group carriers were used as carrier particles having a low charge giving characteristic.

In Embodiments 3 and 6, spherical carriers were used as carrier particles having a high charge giving characteristic, and unfixed-shaped or flat-shaped carriers were used as carrier particles having a low charge giving characteristic, respectively.

In addition to the above described, particles coated with resin can be utilized for carrier particles. For resin material, styrene group resin, vinyl group resin, ethyl group resin, rosin denaturized resin, acryl group resin, polyamido resin, epoxy resin, polyester resin, fluorine resin, silicone resin or the like can be utilized. Then, by properly combining from among these resins according to their charging series, carrier particles having difference charge giving characteristics can be obtained. In particular, for the iron powder group, elongation of the lifetime thereof can be expected by resin coating.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of developing electrophotographic images in color in a copying machine having a photosensitive medium comprising the steps of:

preparing a plurality of developers with each said developer having a different visually appearing color defined by a unique band of different wavelengths by providing a plurality of toners each corresponding to one of said plurality of developer colors, and providing each toner with an amount of each of two types of carrier particles of the same electrical charge polarity with one of the two types of carrier particles having a higher electrical charge level than the other type of carrier particles, to make the material of each color developer have substantially the same electrical charge band in magnitude and width with the band being narrower than that formed by adding only a single type carrier particle having only one electrical charge level to each of said developers, exposing the photosensitive medium to the image to be developed, and applying each said developer of different colors to said medium under substantially the same copying machine operating conditions.

2. The method in accordance with claim 1, wherein the average diameter of one type of carrier particles is substantially larger in comparison with the average diameter of the other type of carrier particles by an amount to provide for the difference in the charge level magnitudes of the two types of carrier particles.

3. The method in accordance with claim 1, wherein ferrite carriers are used as one type of carrier particles.

4. The method in accordance with claim 1, wherein iron powder carriers are used as one type of carrier particles.

5. The method in accordance with claim 1, wherein the two types of said carrier particles are shaped differently to provide for the difference in charge level magnitude of the two types of carrier particles.

6. The method in accordance with claim 1, wherein said carrier particles are magnetized.

7. The method in accordance with claim 1, wherein said carrier particles are coated with resin.

8. The method in accordance with claim 7, wherein material for said resin coat is selected from the resin group consisting of styrene group resin, vinyl group resin, ethyl group resin, rosin denaturized resin, acryl group resin, polyamido resin, epoxy resin, polyester resin, fluorine resin and silicone resin.

9. A method as in claim 1 wherein the quantity of electrical charge on one color developer is within ±10% of the other colors of developers.

10. A method as in claim 1 wherein the quantity of electrical charge on each color developer is within the range of from about 24.1 uC/g to 25.1 uC/g.

* * * * *